US008648803B2

(12) United States Patent
Maier et al.

(10) Patent No.: US 8,648,803 B2
(45) Date of Patent: Feb. 11, 2014

(54) REMOTE CONTROL

(75) Inventors: Ferdinand Maier, Obertrum am See (AT); Erwin Weitgasser, Salzburg (AT); Detlev Magerer, Salzburg (AT)

(73) Assignee: FM Marketing GmbH (AT)

( * ) Notice: Subject to any disclaimer, the term of this patent is extended or adjusted under 35 U.S.C. 154(b) by 184 days.

(21) Appl. No.: 13/366,776

(22) Filed: Feb. 6, 2012

(65) Prior Publication Data

US 2012/0206355 A1 Aug. 16, 2012

(30) Foreign Application Priority Data

Feb. 11, 2011 (EP) ..... 11001130

(51) Int. Cl.
*G09G 5/08* (2006.01)
*G09G 5/00* (2006.01)

(52) U.S. Cl.
USPC ..... 345/160; 345/620

(58) Field of Classification Search
USPC ..... 345/160, 168, 173, 174, 178, 179, 619, 345/620
See application file for complete search history.

(56) References Cited

U.S. PATENT DOCUMENTS 7,539,011 B2 * 5/2009 Shih et al. ..... 361/679.26

FOREIGN PATENT DOCUMENTS

WO 9962287 A2 12/1999

OTHER PUBLICATIONS

European Design Registration No. 001223580-0001; Jul. 6, 2010.
European Design Registration No. 001223580-0002; Jul. 6, 2010.
European Design Registration No. 001223580-0003; Jul. 6, 2010.
European Design Registration No. 001223580-0004; Jul. 6, 2010.
European Design Registration No. 001223580-0005; Jul. 6, 2010.
European Design Registration No. 001223580-0006; Jul. 6, 2010.
European Design Registration No. 001223580-0007; Jul. 6, 2010.
European Design Registration No. 001223580-0008; Jul. 6, 2010.
European Design Registration No. 001223580-0009; Jul. 6, 2010.
European Design Registration No. 001223580-0010; Jul. 6, 2010.
European Design Registration No. 001223580-0011; Jul. 6, 2010.
European Design Registration No. 001223580-0012; Jul. 6, 2010.

* cited by examiner

*Primary Examiner* — Michael Faragalla
(74) *Attorney, Agent, or Firm* — Senniger Powers LLP

(57) ABSTRACT

The remote control device contains two keypads, of which the second keypad is able to be slid into a housing or extracted from it. A sensor detects the sliding position of the second keypad and generates an output signal, that assigns differing control signals to preset keys of the first keypad depending on the sliding position of the second keypad. Additionally the remote control device has two transmission devices with differing directions of emission, with always only one transmission device being activated and in fact depending on the output signal of the sensor.

10 Claims, 2 Drawing Sheets

REMOTE CONTROL

REFERENCE TO RELATED APPLICATION

This application claims priority to European patent application 11001130.1 filed Feb. 11, 2011, the entire disclosure of which is expressly incorporated by reference.

FIELD OF THE INVENTION

The invention relates to an infrared remote control device for multimedia devices with two separated keypads, of which the one keypad in essence has control keys to control certain functions of a controlled device and the other keypad has an alpha keypad for input of letters or texts or an alphanumeric keypad for input of letters, numbers and other symbols.

BACKGROUND

WO 99/62287 A2 shows a remote control device with two keypads, of which the one can be pivoted relative to the other. The first keypad is, so to speak, attached to a foldable cover of the second keypad. A switch detects whether this cover is open or closed and activates one of two transmission devices, which are placed on two different side walls of the housing and thus have directions of emission that in essence are at right angles to each other.

In a version shown there, the foldable cover has no independent keypad, but rather only holes through which the first keypad is accessible. Depending on the folded position of the cover, different functions are assignable to the keys of this keypad.

Another such remote control device is known, for example, from European registered design 001223580-0001. This remote control device has a housing that in essence is cuboid in shape, on whose one side the first keypad is placed and on the opposite side the second keypad is placed. However, what is problematic with this known remote control device is that when the user grasps the remote control device, involuntarily he also operates keys on the keypad that at that moment is on the underside, and thus triggers erroneous signals. Also, placing the remote control device on a base, as for example a table, can cause an undesired emission. To solve this problem, a position sensor could be provided by which it is determined which of the two keypads is pointing upwards or downwards, with only the keypad pointing upward being activated. In addition, the arrangement of the two keypads on opposite sides results in the user being forced to turn the remote control over multiple times while inputting complex commands, until the inputting is complete.

It is known with mobile phones to configure an upper and a lower housing piece so as to slide relative to each other, with the upper housing part having a display and the lower housing part having a keyboard. In a non-functioning state the upper housing part completely covers the lower housing part, so that the keyboard is hidden. In an activated state, the two parts are slid toward each other so that the keyboard is accessible. As a rule, the keyboard has relatively few keys, to which numerical values, i.e. numbers, are assigned, with a switchover key able to be used to select an operating mode in which alpha symbols, i.e. letters, are assigned to the individual keys. In most cases several letters are assigned to one key, which can be called by pressing multiple times on the key in question. Therefore, it is difficult and cumbersome to input texts.

Lastly, with televisions it is also known through pressing certain keys or key sequences on the television to represent a keyboard and to select the individual letters by so-called cursor keys on the remote control device, and by pressing an "enter" key or an "O.k." key, to select the individual letters. Here also, operation is extremely arduous and time-consuming.

SUMMARY OF THE INVENTION

The task of the invention is to further develop the remote control device of the type named initially, so that as desired one of two keypads is available to the user, with one keypad having traditional control keys for remotely controlling a multimedia device or a television, and the other keypad making available keys for alpha symbols or alphanumeric symbols.

Briefly, therefore, the invention is directed to a remote control comprising a housing, a first keypad which has a multiplicity of keys for inputting of control commands, a second keypad for inputting of letters or other symbols, wherein the second keypad is movable relative to the first keypad between a first and a second limit position, and a sensor that in dependence on the position of the second keypad generates an output signal. There are two transmission devices provided on the housing, for transmission of coded signals, of which only one is activated in dependence on the output signal of the sensor, wherein the two transmission devices are placed on two different side walls of the housing, so that the directions of emission of the two transmission devices are essentially at right angles to each other, and wherein keys of the first keypad are assigned different control signals in dependence on the output signal of the sensor. The second keypad is slideable relative to the first keypad between the first and the second limit position, and the keys of the first and the second keypad in the pulled out limit position of the second keypad are accessible from the same side of the remote control device.

Advantageous embodiments and further developments of the invention can be gleaned from the subclaims.

The basic idea of the invention is to situate a slidable keypad in a housing of a remote control device, which is slidable between a completely pushed in first limit position and a completely pulled out second limit position. In the pulled out second limit position, both keypads are in the visual range of the user. The two keypads can then essentially lie on a single plane or also in two planes that form an obtuse angle to each other. In addition the remote control device has two transmission devices, especially for infrared signals with differing directions of emission. In the housing a sensor is provided which determines if the second keypad is pushed in or pulled out. Depending on the position of the second keypad, one of the two transmission devices is activated. The two transmission devices are placed on two different lateral surfaces of the housing of the remote control device that are roughly at right angles to each other.

Provision is further made that depending on the position of the second keypad, also at least some of the function keys of the first keypad are assigned functions other than when the second keypad is pushed in. This preferably relates to the functions of so-called cursor keys.

In a specific embodiment example, the remote control device has an elongated housing that is rectangular when viewed from above, if the second keypad is pushed in. The first keypad with the control keys then emits infrared signals via the short front sides and is held by the user so that the longitudinal axis of the remote control device points to the controlled device.

The second keypad is pulled out of the housing transverse to the named longitudinal axis. The user then has to turn the remote control device roughly 90° in the plane of the first keypad, to operate the second keypad. With this, via the sensor named, the first transmission device on the front side is deactivated and a second transmission device on the second keypad on the longitudinal side of the remote control device distant from the second keypad is activated and at the same time at least the cursor keys of the first keypad are switched over as regards their function. The sensor can be a simple electrical switch, a magnetic switch or some other sensor which generates a signal that designates the position of the second keypad.

BRIEF DESCRIPTION OF THE FIGURES

In what follows the invention will be explained in detail using an embodiment example in connection with the drawings. Shown are.

DETAILED DESCRIPTION OF PREFERRED EMBODIMENTS

Figure 1:
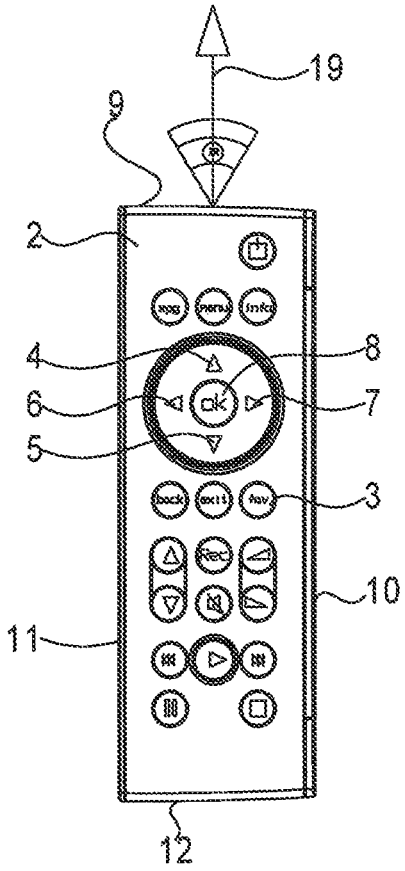
FIG. 1 a top-down view of an upper side of the remote control device according to the invention in a first operating mode.

FIG. 1 shows the remote control device 1 in a first operating mode in which the housing is configured so that one side 2 forms an upper side which has a first keypad 3 with a multiplicity of keys, the operation of which triggers predetermined control functions on a controlled device not depicted.

Of particular importance here are four cursor keys 4, 5, 6, 7, to which, in this operating mode, are assigned the functions "up," "down," "left," and "right" in the sequence indicated. These keys 4 to 7 are distributed over a circular path and in the middle of them an additional key 8 is provided, which serves as the confirmation key.

On one front side 9 of the housing, which is roughly at right angles to the upper side 2, a first infrared transmitter unit 13 is placed. For bi-directional operation it can also be a transmitter-receiver unit. In the first operating mode depicted in FIG. 1, transmission unit 13 is activated, i.e. upon pressing one of the keys of first keypad 3, it sends a coded infrared signal in a first direction of emission 19.

Figure 2:
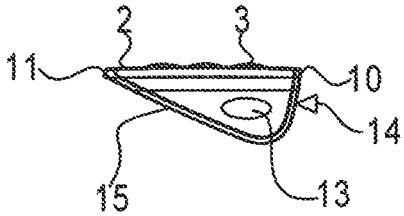
FIG. 2 a front view of the remote control device of FIG. 1.

The housing of the remote control device has two lateral surfaces 10 and 11 which adjoin the longitudinal sides of upper side 2, with one of the lateral surfaces, here lateral surface 11, being extremely narrow, so that the front view of FIG. 2 or a cross section through the housing is close to triangular in shape.

Lastly, the housing has an underside 15, which connects the two lateral surfaces 10 and 11 with each other and which is inclined to upper side 2 at an acute angle which here, for example, is 25°. In any case, to one skilled in the art it is clear that the two lateral surfaces 10 and 11 can also be equally long, with the result that the housing then has an essentially rectangular cross section and the upper side 2 and the underside 15 run essentially parallel to each other.

However, the configuration of the upper and lower side at an acute angle has some advantages which will be explained farther on.

Figure 4:
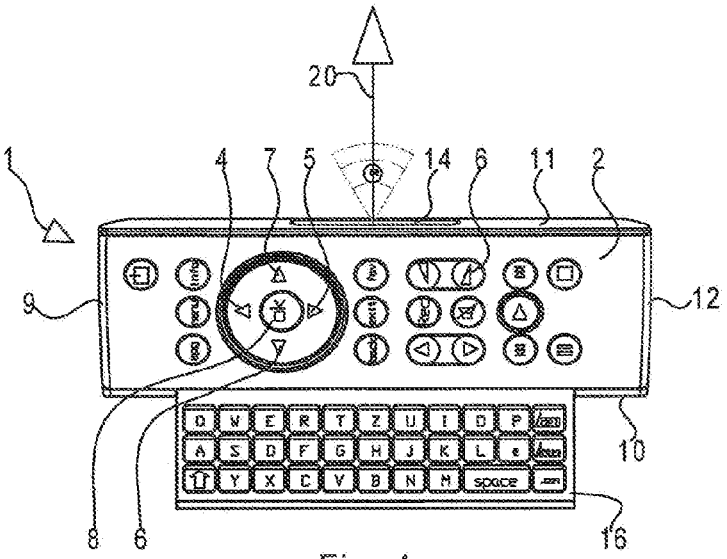
FIG. 4 a top-down view of the remote control device according to the invention in the second operating mode with a pulled out second keypad.
Figure 5:
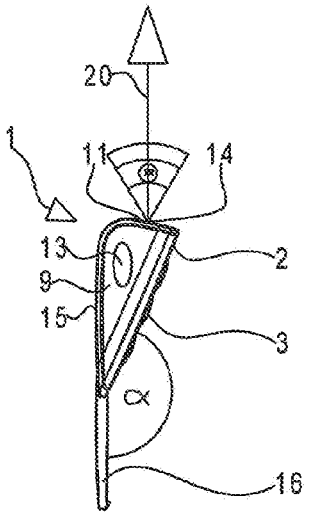
FIG. 5 a front view of the remote control device of FIG. 4.
Figure 6:
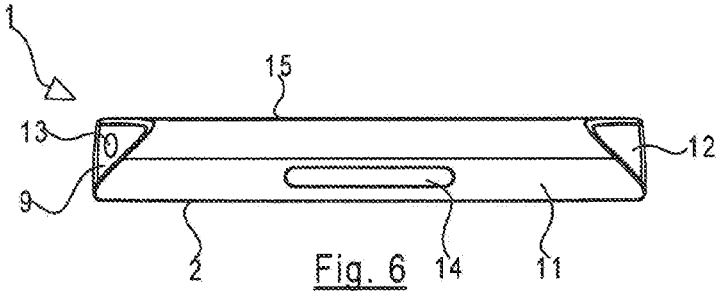
FIG. 6 a side view of the remote control device of FIG. 4.
Figure 7:
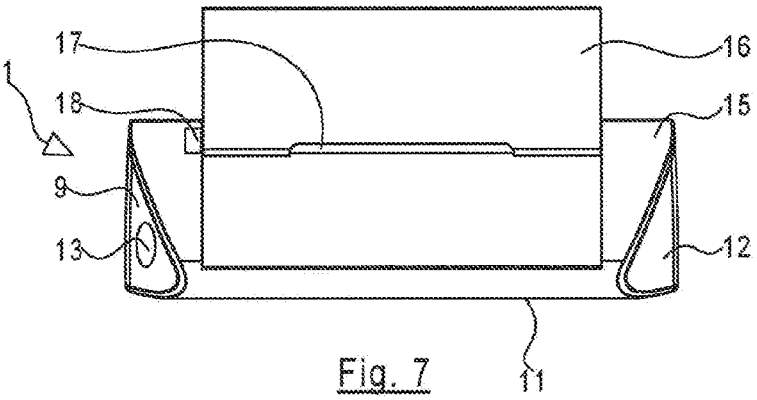
FIG. 7 a view of the underside of the remote control device of FIG. 4.

On the underside 15, a slidable keypad is situated, that here is designated as the second keypad 16, and, as depicted in FIG. 4, is a so-called alpha keypad, which can have keys arrayed differently depending on the country, for example designed in the form of the European QWERTZ keyboard or the QWERTY keyboard usual in Anglo-Saxon areas. Second keypad 16 is slidable parallel to the underside 15 between two limit positions and in fact between a first, completely pushed in position, in which it is not visible in the top-down view of FIG. 1, and a second, completely pulled out position which is depicted in FIG. 4, and in which the second keypad is completely visible.

Figure 3:
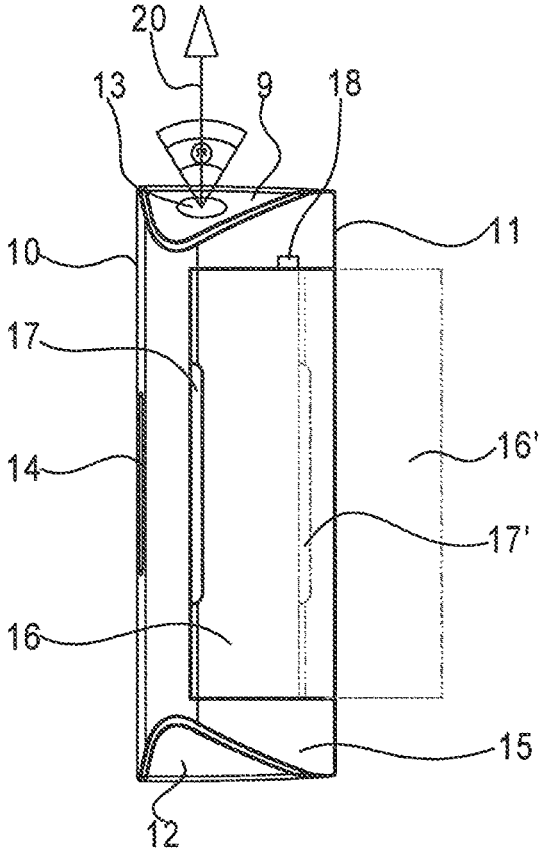
FIG. 3 a view of the underside of the remote control device of FIG. 1.

To facilitate sliding second keypad 16 out, a gripping recess 17 is provided, at which second keypad 16 can be grasped, to bring it into the position depicted with dotted lines in FIG. 3 and provided with the reference symbol 16'.

In the embodiment example depicted, the keypad is slid out on side surface 10. On the other side surface 11, a second infrared transmission device 14 is attached, which emits infrared-coded signals from side surface 11 in a second direction of emission 20, that runs roughly perpendicular to the first direction of emission 16.

In the housing of the remote control device, a sensor 18 is situated, which detects the state of second keypad 16, namely whether it is fully pushed in or fully pulled out. This sensor 18 can be a simple electrical switch, which is activated mechanically by the sliding of second keypad 16. It is clear to one skilled in the art that other forms of switches or sensors can be used, for example magnetically operated switches or capacitance-operated switches, which provide second keypad 16 with an appropriate electrical signal depending on the pushed in or pulled out position of second keyboard 16.

To operate second keypad 16, the user turns the remote control to the position shown in FIG. 4 so that second keypad 16 points to the user and the lateral side 11 with the second infrared transmitter 14 in the direction of the device to be controlled. If second keyboard 16 is pulled out, this essentially lies on a plane to the underside 15 of the housing. If the user then lays the remote control device on a table with underside 15, then second keypad 16 is directed horizontally, and first keypad 3 is inclined from it at an obtuse angle in the direction of the user. Using switch 18, in this position of second keypad 16, the second IR transmission unit 14 is activated and first IR transmission unit 13 is deactivated. Additionally, some of the keys, especially the four cursor keys 4, 5, 6 and 7 are reprogrammed as regards their function, i.e., other encoded infrared signals are assigned to these keys. Key 4, which has the "up" function in the operating mode of FIG. 1, now obtains the "left" function in the second operating mode, which is depicted in FIG. 4. In a corresponding way, key 5 is assigned the "right" function, key 6 the "down" function and key 7 the "above" function, so that the arrow symbols shown on these keys 4 to 7 are adapted to the orientation of the remote control device according to FIG. 4.

In contrast, the assignment of the other keys on the first keypad 2 can remain unchanged, but—depending on the instance of application—these keys also can be assigned to other functions.

In the position of FIG. 4, the user can input whatever texts in the normal manner via alpha keypad 16 and transmit them via the second IR transmission unit 14.

If the user wishes to switch back to the first operating mode (without second keypad 16), then he slides second keypad 16 again fully into the underside 15 of the housing, by which the first IR transmission unit 13 is again activated, the second IR transmission unit 14 is deactivated, and the function of the named keys 4 to 7 is again switched back into the first operating mode.

In view of the above, it will be seen that the several objects of the invention are achieved and other advantageous results attained.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above compositions and methods without departing from the scope of the invention, it is intended that all matter contained in the above description and shown in the accompanying drawings shall be interpreted as illustrative and not in a limiting sense.

The invention claimed is:

1. Remote control comprising:

a housing;

a first keypad which has a multiplicity of keys for inputting of control commands;

a second keypad for inputting of letters or other symbols;

a sensor that in dependence on the position of the second keypad generates an output signal;

two transmission devices provided on the housing, for transmission of coded signals, of which only one is activated in dependence on the output signal of the sensor, wherein the two transmission devices are placed on two different side walls of the housing, so that the directions of emission of the two transmission devices are essentially at right angles to each other, and wherein keys of the first keypad are assigned different control signals in dependence on the output signal of the sensor;

wherein the second keypad is slideable relative to the first keypad between a first completely pushed in limit position and a second completely pulled out limit position; and the keys of the first and the second keypad in the second completely pulled out limit position of the second keypad are accessible from the same side of the remote control device.

2. Remote control device according to claim 1, wherein the first keypad and the second keypad in the pulled out limit position of the second keypad are at an obtuse angle to each other.

3. Remote control device according to claim 2, wherein the obtuse angle is greater than 165°, and less than 180°.

4. Remote control device according to claim 1, wherein the keys of the first keypad, to which differing control signals are assigned in dependence on the output signal of sensor, are cursor keys, by which a motion direction of a cursor is controllable.

5. Remote control device according to claim 2, wherein the keys of the first keypad, to which differing control signals are assigned in dependence on the output signal of sensor, are cursor keys, by which a motion direction of a cursor is controllable.

6. Remote control device according to claim 3, wherein the keys of the first keypad, to which differing control signals are assigned in dependence on the output signal of sensor, are cursor keys, by which a motion direction of a cursor is controllable.

7. Remote control device according to claim 1, wherein the sensor is an electrical switch, which can be operated mechanically by sliding the second keypad.

8. Remote control device according to claim 2, wherein the sensor is an electrical switch, which can be operated mechanically by sliding the second keypad.

9. Remote control device according to claim 1, wherein the sensor is a magnetic sensor or a capacitance sensor, which, depending on the relative position of the second keypad in relation to the first keypad, generates the output signal.

10. Remote control device according to claim 2, wherein the sensor is a magnetic sensor or a capacitance sensor, which, depending on the relative position of the second keypad in relation to the first keypad, generates the output signal.

* * * * *

UNITED STATES PATENT AND TRADEMARK OFFICE

CERTIFICATE OF CORRECTION

PATENT NO. : 8,648,803 B2
APPLICATION NO. : 13/366776
DATED : February 11, 2014
INVENTOR(S) : Ferdinand Maier et al.

It is certified that error appears in the above-identified patent and that said Letters Patent is hereby corrected as shown below:

In the Specification

Column 2, Line 10:

"one of two keypads is available to the user, with one keypad"

Should read

--one or two keypads are available to the user, with one keypad--

Signed and Sealed this
Twentieth Day of January, 2015

Michelle K. Lee

Michelle K. Lee
*Deputy Director of the United States Patent and Trademark Office*